United States Patent [19]

Sawazaki

[11] Patent Number: 4,570,461

[45] Date of Patent: Feb. 18, 1986

[54] EYELET AND TERRY KNIT FABRIC AND METHOD

[75] Inventor: Masatoshi Sawazaki, Kobe, Japan

[73] Assignee: Precision Fukuhara Works, Ltd., Kobe, Hyogo, Japan

[21] Appl. No.: 625,113

[22] Filed: Jun. 27, 1984

[30] Foreign Application Priority Data

Jul. 29, 1983 [JP] Japan ..... 58-140097

[51] Int. Cl.[4] ..... D04B 9/12; D04B 15/02

[52] U.S. Cl. ..... 66/194; 66/198

[58] Field of Search ..... 66/93, 95, 194, 198

[56] References Cited

U.S. PATENT DOCUMENTS

| | | | |
|---|---|---|---|
| 846,353 | 3/1907 | Scott | 66/198 |
| 2,286,806 | 6/1942 | Hurd et al. | 66/198 X |
| 2,340,664 | 2/1944 | Holmes et al. | 66/198 |
| 3,208,242 | 9/1965 | Fors | 66/194 X |
| 3,561,441 | 2/1971 | Lombardi | 66/194 X |

*Primary Examiner*—Wm. Carter Reynolds

*Attorney, Agent, or Firm*—Bell, Seltzer, Park & Gibson

[57] ABSTRACT

This fabric includes a repeating pattern of courses containing wales of jersey stitch loops and eyelets in selected sinker wales between the jersey stitch loops, and a repeating pattern of courses containing wales of jersey stitch loops knit with a pair of plated yarns and with one of the yarns forming terry loops in selected sinker wales between the jersey stitch loops. The eyelets and terry loops are each formed by pelerine points with only the outer ends of the pelerine points being used to form the terry loops while the inner and outer portions of the pelerine points are used to form the eyelets. The eyelets provide ventilation to the knit fabric while the terry loops provide an attractive pattern and moisture-absorbing characteristics to the knit fabric. The method is carried out on a circular knitting machine including multiple knitting stations, a cylinder with cylinder needles, and pelerine points carried by the dial.

3 Claims, 10 Drawing Figures

EYELET AND TERRY KNIT FABRIC AND METHOD

FIELD OF THE INVENTION

The present invention relates generally to the art of knitting and more particularly to a weft knit jersey fabric having both eyelet openings and terry pile loops therein and to a method of making the fabric on a multi-feed cylinder and dial circular knitting machine.

BACKGROUND OF THE INVENTION

Weft knit jersey fabric has been used in the manufacture of articles of athletic clothing or the like wherein the fabric comes into contact with the skin of the wearer of the clothing. One such fabric is provided with spaced eyelet openings extending therethrough while another such fabric is provided with terry pile loops therein. On the one hand, the fabric having the eyelet openings therein has good ventilation owing to the openings while it has poor absorption of body perspiration or of moisture. On the other hand, the fabric having the terry pile loops has good absorption of body perspiration and moisture owing to the terry pile loops while it has poor ventilation.

SUMMARY OF THE INVENTION

Accordingly, with the foregoing in mind, it is an object of the present invention to provide a novel weft knit jersey fabric having a combination of both eyelet openings and terry pile loops therein to provide the fabric with good absorption and with good ventilation qualities. The stitch structures of the eyelet openings and of the terry pile loops are both combined in the fabric of the present invention.

The courses of the fabric containing the eyelet openings are made of a first body yarn while the courses of the fabric containing the terry pile loops are made of a second body yarn and of a pile yarn.

It is another object of the present invention to provide a novel method of making the stitch structures of both the eyelet openings and of the terry pile loops of the novel fabric on the same multi-feed cylinder and dial circular machine.

The machine used to make the present fabric has a slotted needle cylinder with vertically movable latch needles therein and has a slotted dial with dial members or pelerine points therein. These dial members have stitch drawing surfaces over which elongated sinker wales are drawn and which have means to spread such loops coursewise over the needles flanking the dial members, thereby to provide the eyelet openings. The machine is normally operated in one manner, with full use of the dial members, to make courses of fabric having the eyelet openings therein, and, according to the present invention, it is also operated in another manner, with limited use of the dial members, to make courses of fabric having the terry pile loops therein. In the limited use of the dial members only their stitch drawing surfaces are used.

It is known that terry pile loop jersey fabric has been made upon cylinder and dial circular machines having latch needles in the cylinder and having hookless dial needles or the like in the dial. The body and pile yarns are both fed to the cylinder needles while only the pile yarn is drawn over the hookless dial needles. However, such a machine is not capable of also making the eyelet openings in the fabric.

The eyelet and terry weft knit jersey fabric of the present invention can have the terry loops spaced apart both walewise and coursewise to produce a thinner and lighter fabric than the conventional knitted terry fabric where the terry loops are normally formed in every sinker wale. When the fabric of this invention is used to form clothing with the terry loops on the inside, perspiration is absorbed by the terry loops and is easily evaporated and dispersed because of the open ventilation provided by the pattern of open eyelets so that the clothing feels light and refreshingly cool to the wearer. When the fabric of the present invention is used to form articles of clothing with the terry loops on the outside, the terry loops can be arranged to provide an attractive pattern interspersed among and with the open eyelets.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
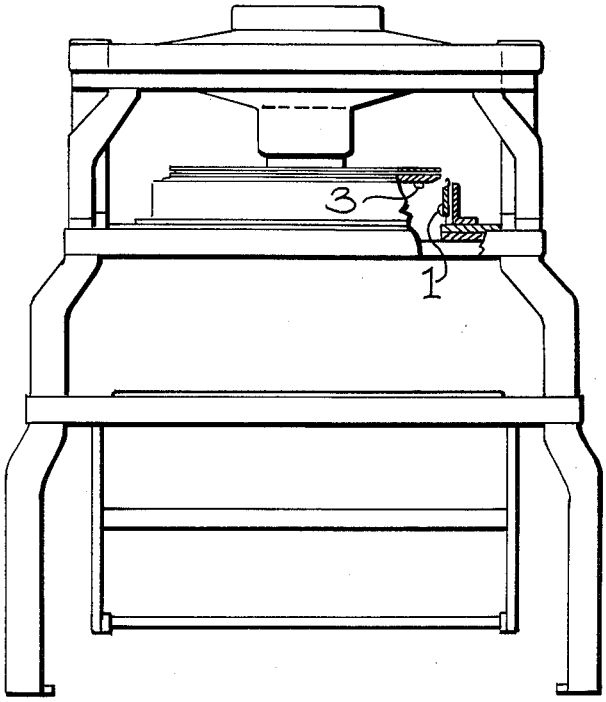
FIG. 1 is an elevational view of a circular knitting machine and with parts broken away to illustrate the needle cylinder and dial.

As illustrated in FIG. 1, the circular knitting machine includes the usual frame rotatably supporting a needle cylinder 1 and a dial 3. The needle cylinder 1 is provided with the usual type of vertically movable cylinder latch needles 2 (FIG. 3) and the dial 3 is provided with dial members or pelerine points 4 supported for radial movement therein. The pelerine points 4 are formed in two parts and the outer ends are provided with stitch drawing ledges or surfaces 4A and outwardly spread legs which form an open space 4B therebetween. The cylinder needles 2 and the pelerine points 4 intersect each other at right angles.

Figure 2:
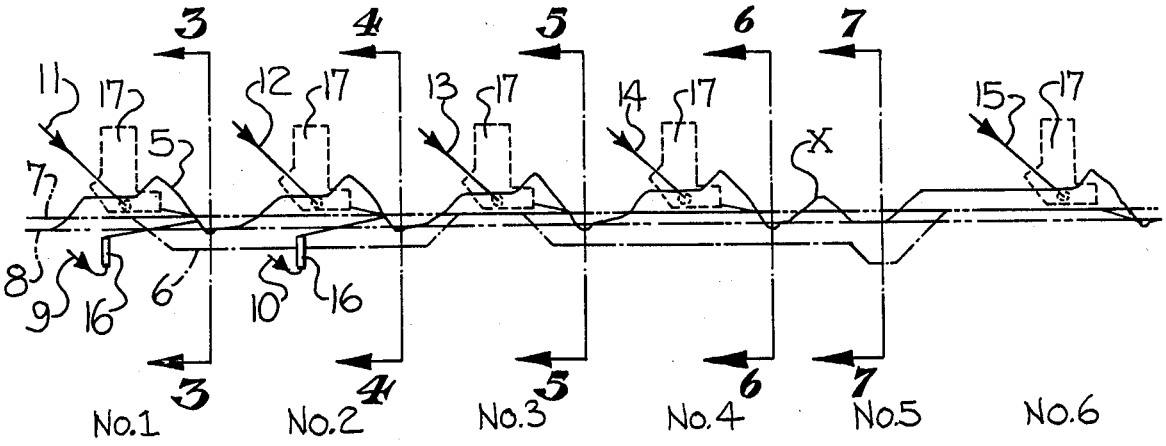
FIG. 2 is a somewhat schematic developed view showing the path of travel of the hooks of the needles and the pelerine points at each of the six stations.

The solid line 5 in FIG. 2 illustrates the path of travel of the upper hooked ends of the cylinder needles 2 as they pass the successive station Nos. 1–6 while the one-dot line 6 shows the path of travel of the outer ends of the pelerine points 4. The upper two-dot line 7 indicates the outer edge of the dial 3 while the lower two-dot line 8 indicates the upper edge of the needle cylinder 1. As illustrated in FIG. 2, ground or body yarns 9, 10 are fed at respective station Nos. 1 and 2 while terry yarns 11, 12 (shown in the drawings as being striped for ease of identification) are fed at respective station Nos. 1 and 2. Eyelet yarns 13, 14 are fed at respective station Nos. 3 and 4 while a plain jersey yarn 15 is fed at station no. 6. The ground or body yarns 9, 10 are fed to the cylinder needles 2 through yarn carriers 16 at station nos. 1 and 2 while the terry yarns 11, 12, eyelet yarns 13, 14 and plain jersey yarn 15 are fed to the cylinder needles 2 and the pelerine points 4 through yarn carriers 17 at station Nos. 1, 2, 3, 4 and 6.

Figure 3:
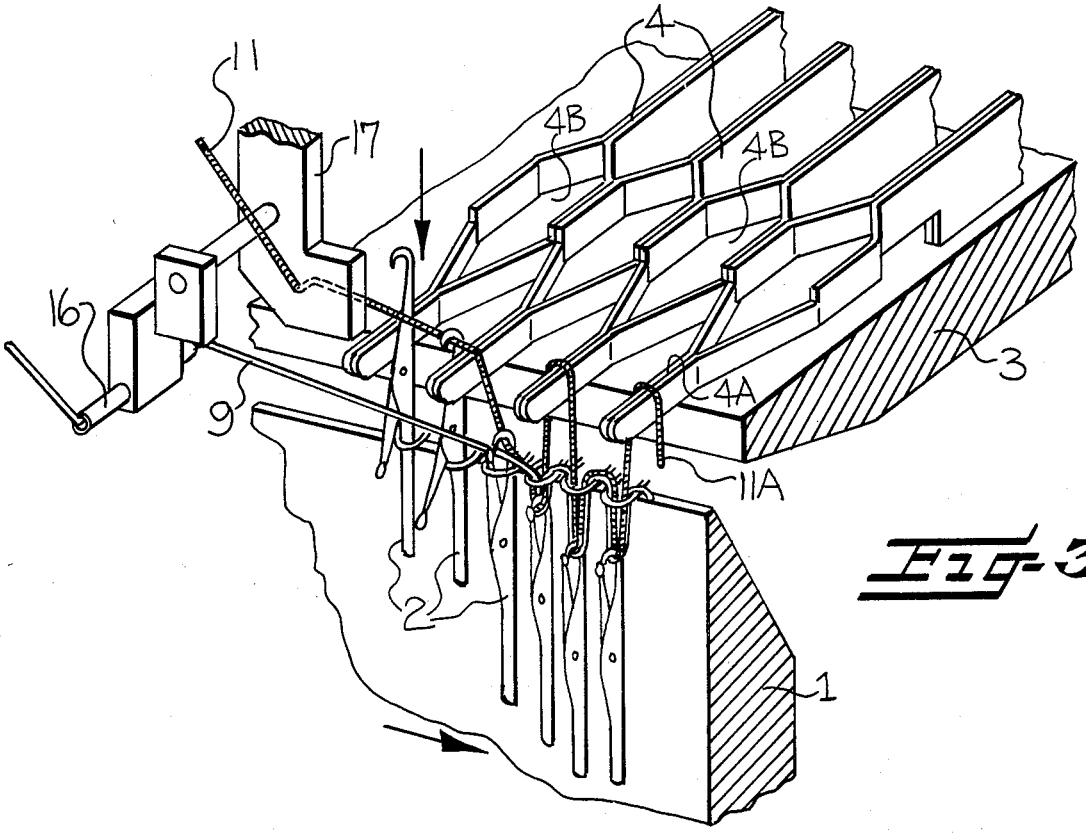
FIG. 3 is an isometric sectional view illustrating the formation of terry loops at station No. 1, being taken substantially along the line 3—3 in FIG. 2.

As is illustrated in FIG. 3, the body or ground yarn 9 is fed through yarn carrier 16 and to the cylinder needles 2 at a lower level than the pelerine points 4 while the terry yarn 11 is fed through the yarn carrier 17 and at a level above the stitch drawing surfaces 4A of the pelerine points 4. As the cylinder needles 2 are successively lowered at station No. 1, the hook of the cylinder needle 2 engages and forms a jersey stitch loop of both the ground yarn 9 and terry yarn 11 while the terry yarn 11 is drawn down over the stitch drawing surfaces 4A of the outwardly positioned pelerine points 4 to form terry loops, indicated at llA. The pelerine points 4 remain in the outer position shown in FIG. 3 while the cylinder needles 2 successively move downwardly to stitch drawing position to cast off the previously formed loops and the needles 2 are again raised upwardly as they approach station No. 2.

Figure 8:
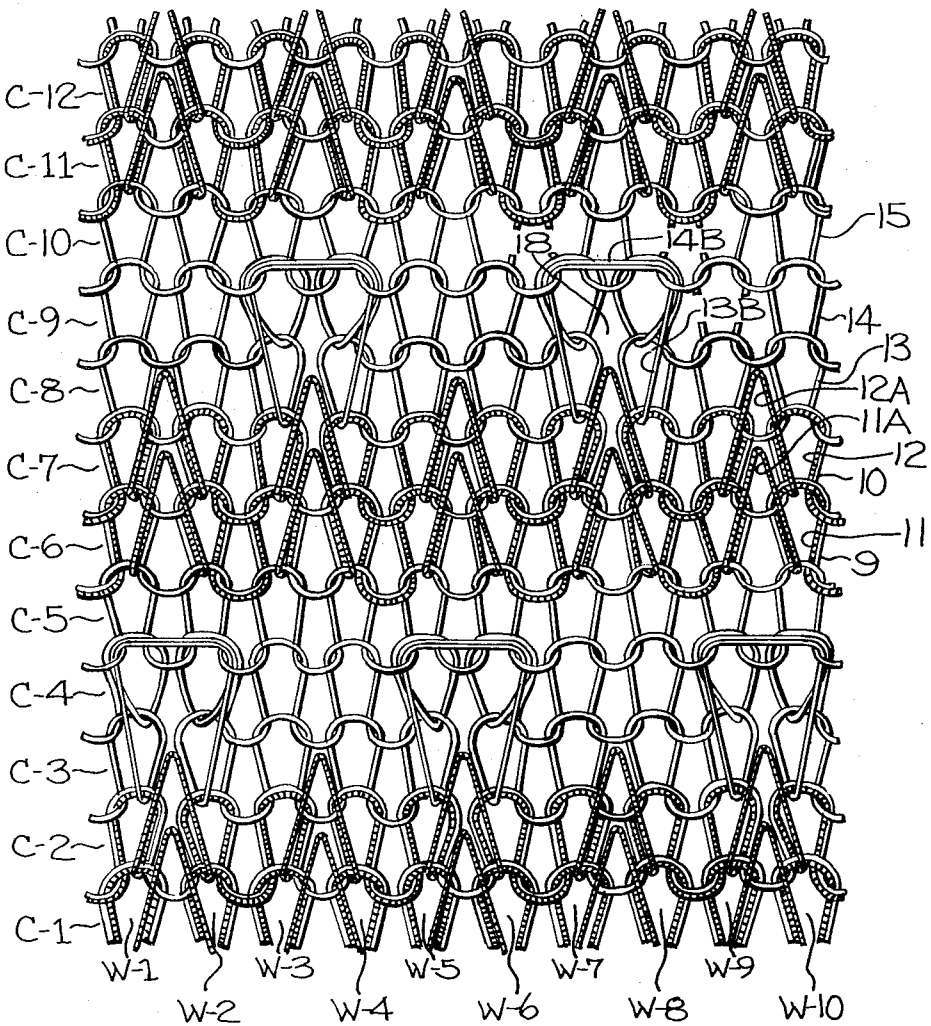
FIG. 8 is a greatly enlarged fragmentary elevational view of a portion of the knit fabric of the present invention looking at the back or inside and showing one preferred arrangement of terry loops and eyelets.

The course formed at station No. 1 is of the type indicated at course C-6 in FIG. 8. It will be noted that the body yarn 9 and the terry yarn 11 are knit together and jersey stitch loops are formed of both yarns in every wale W-1 through W-10 while the terry yarn 11 forms terry loop llA in sinker wales between selected needle wales. The terry loops 11A are shown in FIG. 8 as being positioned between alternate pairs of adjacent needle wales.

Figure 4:
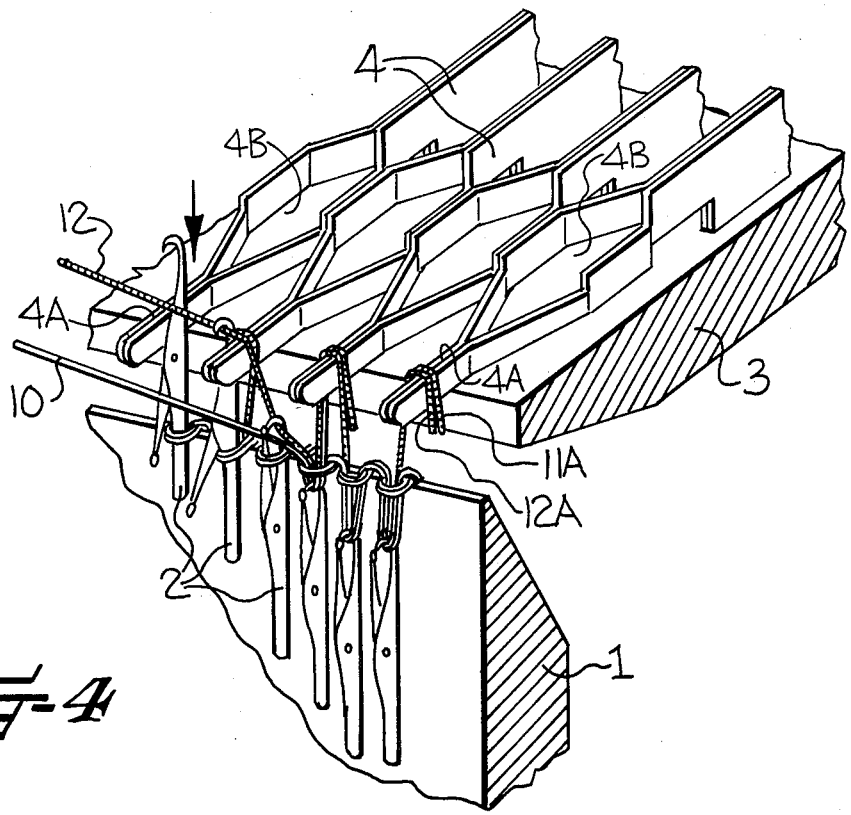
FIG. 4 is a view similar to FIG. 3 and illustrating the formation of terry loops at the station No. 2, being taken substantially along the line 4—4 in FIG. 2.

At station No. 2, as illustrated in FIG. 4, the ground or body yarn 10 is fed below the level of the pelerine points 4 while the terry yarn 12 is fed above the level of the stitch drawing surfaces 4A of the pelerine points 4 and both the ground yarn 10 and terry yarn 12 are engaged and lowered by the hooks of the cylinder needles 2 as they are drawn down to stitch-forming position to form jersey stitch loops of both yarns in each needle wale while casting off the previously formed needle loops. The outer ends of the pelerine points 4 remain in an outer position as they move from station No. 1 to station No. 2, as indicated by the single-dot line 6 in FIG. 2. The pelerine points 4 thus continue to support the terry loops 11A formed at station No. 1 and also form another terry loop 12A. As the cylinder needles pass station No. 2, they are again raised upwardly while the pelerine points 4 are withdrawn so that the terry loops llA and 12A are released.

The course formed at station No. 2 is indicated at course C-7 in FIG. 8 and includes jersey stitch loops formed of both the ground yarn 10 and the terry yarn 12 and terry loops 12A formed in sinker wales between selected needle wales. As illustrated in course C-7, the terry loops 12A are formed in the same sinker wales as the terry loops llA.

Figure 10:
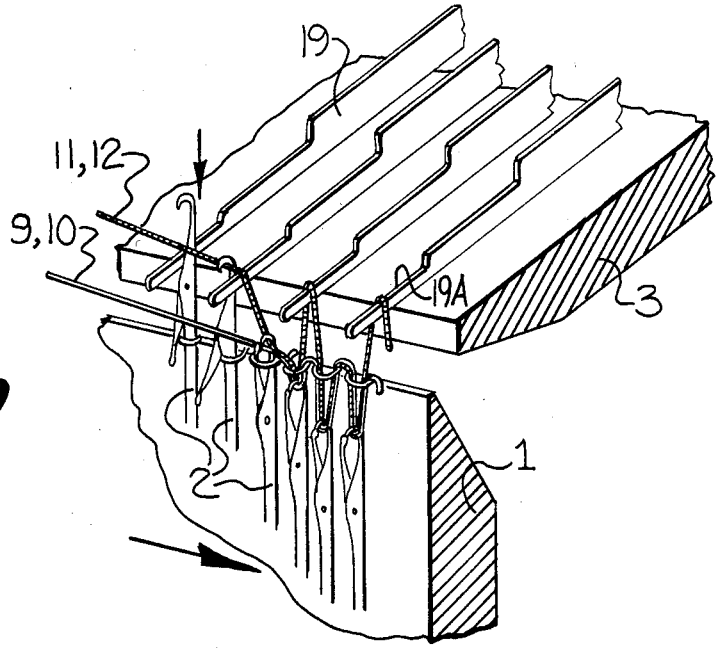
Fig-10 (PRIOR ART)
FIG. 10 is a view similar to FIGS. 3 and 4 and illustrating the conventional prior art manner in which terry loops are normally formed by the use of terry points or needles without hooks.

The terry loops 11A and 12A have been described and illustrated as being formed of the terry yarns 11, 12 at the respective first and second station Nos. 1 and 2 by the stitch drawing surfaces of the pelerine points 4, as illustrated in FIGS. 3 and 4. This is in contrast to the conventional prior art method of forming terry loops, as shown in FIG. 10. In the prior art method, the terry loops 11A and 12A are shown being formed over the outer ends of dial points or needles without hooks, of the type indicated at 19 in FIG. 10. In this prior art method, the ground or body yarns 9, 10 would have been fed in the low positions at station Nos. 1 and 2 to form stitch loops on the cylinder needles 2 while the terry yarns 11, 12 would have been fed at a higher elevation above the stitch drawing surfaces 19A of the dial points 19 to form terry loops over the outer ends. By using the pelerine points 4 to form the terry loops, in accordance with the present invention, these pelerine points 4 can be selectively used to form either eyelets or terry loops.

Figure 5:
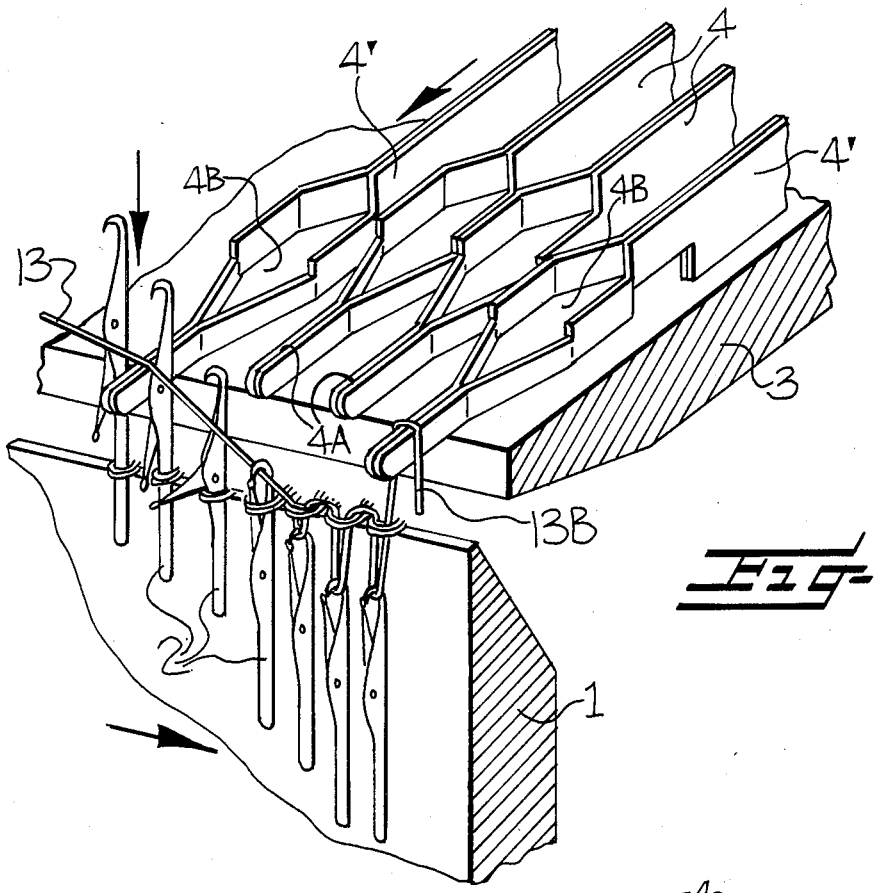
FIG. 5 is a view similar to FIG. 4 and illustrating the formation of held loops for eyelets at station No. 3, being taken substantially along the line 5—5 in FIG. 2.

As illustrated in FIG. 5, only selected pelerine points, indicated at 4', are moved outwardly at station No. 3 so that the eyelet yarn 13 is fed over the stitch drawing surfaces 4A of only the outwardly projected pelerine points 4' while the non-selected pelerine points 4 remain in an inner position and the eyelet yarn 13 is fed to the hooks and forms plain stitch loops on all of the cylinder needles 2. As the cylinder needles 2 descend to stitch-drawing level, they cast off the old loops and a new needle loop is formed. The eyelet yarn 13 that extends over the stitch drawing surfaces 4A of the outwardly projected pelerine points 4' is held thereon as the cylinder needles 2 at both sides thereof form stitch loops to form an eyelet loop in the sinker wale, as indicated at 13B in FIG. 5. The pelerine points 4' continue to remain in an outer position as they move from station No. 3 to station No. 4, as indicated by the single-dot line 6 in FIG. 2, thereby maintaining the eyelet loop 13B thereon.

The course formed at station No. 3 is indicated at C-8 in FIG. 8 and includes plain single yarn stitch loops of the eyelet yarn 13 in every needle wale. The eyelet loops 13B formed in course C-8 are maintained on the pelerine points 4'.

Figure 6:
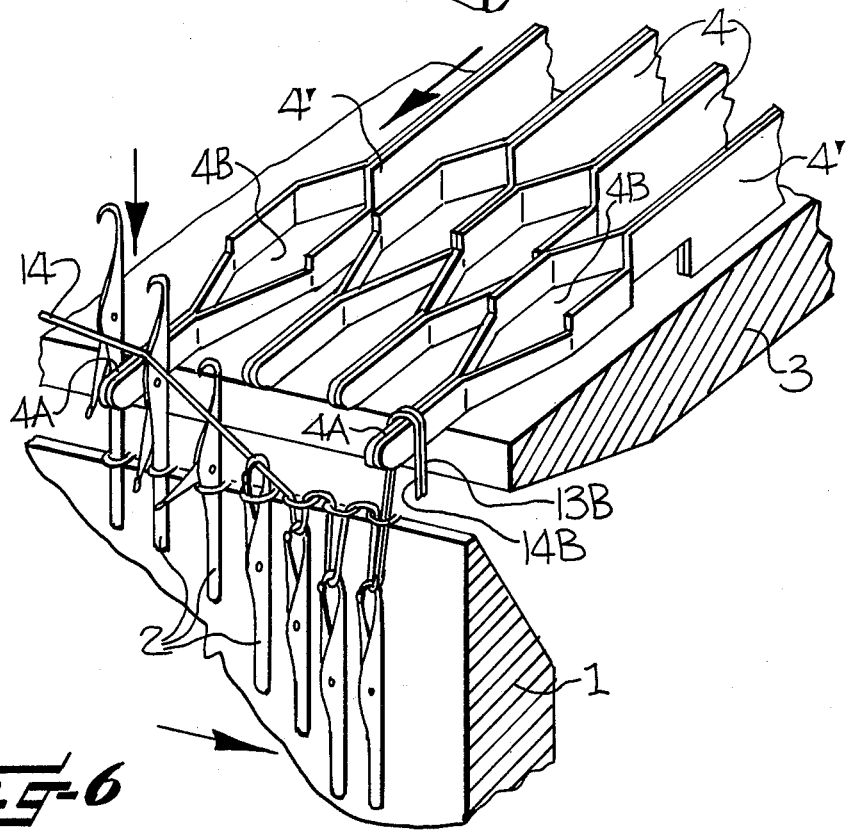
FIG. 6 is a view similar to FIG. 5 and illustrating the formation of additional held loops at station No. 4, being taken substantially along the line 6—6 in FIG. 2.

As illustrated in FIG. 6, eyelet yarn 14 is fed to and forms plain stitch loops on all cylinder needles 2 at station No. 4 while eyelet loops 14B are formed over the stitch drawing surfaces 4A of the selected pelerine points 4' while the non-selected pelerine points 4 remain in the inner position. Thus, plain stitch loops are formed in all of the needle wales at station No. 4, as indicated at course C-9 in FIG. 8, while the eyelet loop 14B of the eyelet yarn 14 is maintained on the selected pelerine points 4'.

Figure 7:
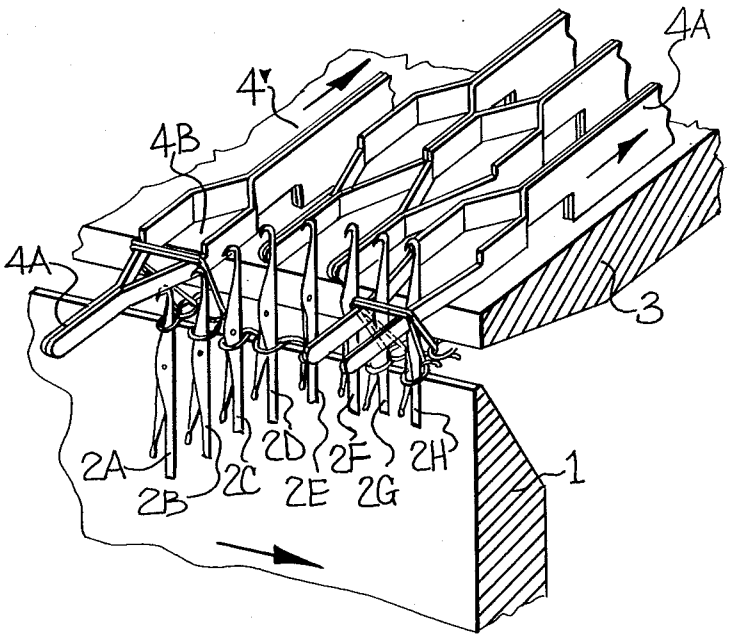
FIG. 7 is a view similar to FIG. 6 and illustrating the manner in which the held loops are spread open and transferred to the cylinder needles at station No. 5, being taken substantially along the line 7—7 in FIG. 2.

As indicated in FIGS. 2 and 7, no yarn is fed at station No. 5 and the cylinder needles 2 are raised to tuck level, indicated at X in FIG. 2, so that the loops on the needles do not pass below the open latch. As shown in FIG. 7, the selected pelerine points 4' with eyelet loops 13B, 14B are further moved outwardly to let two adjacent cylinder needles, indicated at 2A and 2B, raise upwardly between the legs and through the open space 4B with their hooks inside of the spread-apart eyelet loops 11A and 12A while plain stitch loops are formed on the cylinder needles 2C, 2D, 2E, and 2F. The pelerine points 4′ are then moved inwardly so that the eyelet loops llA, 12A are spread over and placed in the hooks of the raised flanking needles, as indicated by cylinder needles 2G and 2H in FIG. 7. These flanking cylinder needles 2G and 2H are then lowered but do not shed their stitch loops since they have not been raised to the highest or clear position at station No. 5. The coursewise spreading of the eyelet loops 13B and 14B onto the flanking needle wale stitches is indicated in course C-9 of FIG. 8. These spread eyelet loops 13B and 14B are held with the plain stitch loops formed in the needle wales of this course C-9 until they are shed with the subsequent knitting of course C-10.

At station No. 6, the plain jersey yarn 15 is fed to all of the cylinder needles 2 after they have been raised to the clear level, as indicated in FIG. 2, so that all needle loops, including the two eyelet loops 13B and 14B move below the latch and are cast off as new plain jersey stitch loops are formed in all of the needle wales, as indicated in course C-10 of FIG. 8. The casting off of the eyelet loops 13B, 14B forms an eyelet, as indicated at 18 in FIGS. 8 and 9 in the fabric. The eyelet 18 extends over two courses and is positioned in sinker wales between selected pairs of cylinder needle stitch loop wales.

Figure 9:
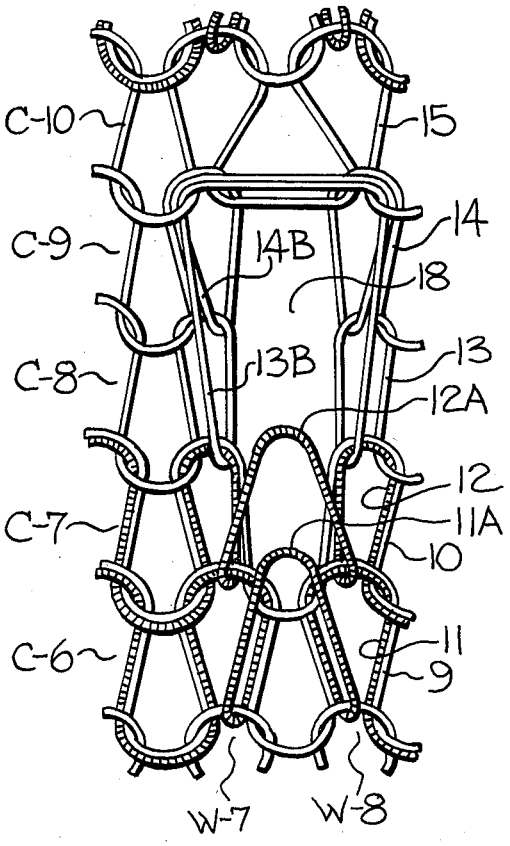
FIG. 9 is a greatly enlarged fragmentary view of a small portion of FIG. 8.

The fabric illustrated in FIGS. 8 and 9 is looking from the inside or backside of the fabric and illustrates one particular type of arrangement of terry courses, eyelet courses and plain courses which may be used in the practice of the present invention. In this particular fabric, pairs of terry loop courses (courses C-6 and C-7) are followed by pairs of eyelet courses (courses C-8 and C-9), and a single plain jersey course (course C-10). The eyelets 18 in courses C-8 and C-9 are offset or staggered relative to the eyelets in courses C-3 and C-4 of FIG. 8. However, it is to be understood that single terry loop courses could alternate with single eyelet courses so that it is possible to produce a knit fabric with a variety of eyelet patterns and a variety of terry loop patterns. Also, the terry loops may be aligned or staggered in the walewise direction and the eyelets may also be aligned or staggered in the walewise direction.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A weft knit jersey fabric having a combination of eyelet openings and of terry pile loops therein, the fabric having courses of jersey stitches in a series of recurrent needle wales connected by sinker wales, said jersey stitches of certain of said courses being formed of only a first body yarn while said jersey stitches of other of said courses being formed of a second body yarn and of a pile yarn, said certain and said other courses alternating in said fabric, a plain course of jersey stitches positioned between some of said certain and said other courses, the structure of selected pairs of jersey stiches of said first body yarn in adjacent needle wales of said certain courses forming an eyelet loop in the intervening sinker wale, the yarn of said eyelet loop being spread coursewise and being incorporated in flanking jersey stitches of said first body yarn in said certain courses and to thereby form said eyelet openings in the fabric, and the structure of selected pairs of adjacent needle wale jersey stitches of said second body yarn and of said pile yarn in said other courses forming a terry loop in the intervening sinker wale, said pile yarn between said adjacent needle wale jersey stitches being elongated relative to the corresponding sinker wale loops of said second body yarn and to thereby form said terry pile loops, said certain courses containing said eyelet openings being devoid of said terry pile loops, and said other courses containing said terry pile loops being devoid of said eyelet openings.

2. A fabric according to claim 1 wherein said fabric includes front and rear sides, and wherein said eyelet loops and said terry pile loops are both disposed on said rear side of said fabric.

3. A fabric according to claim 1 wherein a decorative pattern is formed by a combination of said eyelet openings and of said terry pile loops.

* * * * *